US005169322A

United States Patent [19]

Frantz et al.

[11] Patent Number: 5,169,322

[45] Date of Patent: Dec. 8, 1992

[54] RECEPTACLE HEADER OF LOW HEIGHT FOR CONNECTOR TO MULTIPLE PINS

[75] Inventors: Robert H. Frantz, Newville; William J. Garver, Harrisburg; Benjamin H. Mosser, III, Middletown; Ronald M. Weber, Lebanon, all of Pa.

[73] Assignee: AMP Incorporated, Harrisburg, Pa.

[21] Appl. No.: 851,254

[22] Filed: Mar. 13, 1992

Related U.S. Application Data

[63] Continuation-in-part of Ser. No. 787,842, Nov. 4, 1991, abandoned.

[51] Int. Cl.[5] ..... H01R 9/09

[52] U.S. Cl. ..... 439/82; 439/83; 439/75; 439/378

[58] Field of Search ..... 439/55, 62, 78, 81, 439/82, 83, 876, 74, 75, 378

[56] References Cited

U.S. PATENT DOCUMENTS

| | | | |
|---|---|---|---|
| 3,487,350 | 12/1969 | Hammell | 339/17 |
| 3,548,369 | 12/1970 | Garver | 339/258 |
| 4,072,376 | 2/1978 | Shannon | 339/17 C |
| 4,076,355 | 2/1978 | Olsson et al. | 339/17 C |
| 4,099,615 | 7/1978 | Lemke et al. | 206/329 |
| 4,515,422 | 5/1985 | Pritulsky | 339/17 C |
| 4,586,607 | 5/1986 | Dubbs et al. | 206/329 |
| 4,767,342 | 8/1988 | Sato | 439/83 |
| 4,934,945 | 1/1990 | Nakamura | 439/75 |

*Primary Examiner*—Neil Abrams

[57] ABSTRACT

An electrical connector (19) for mounting against a circuit board (13) comprises, an insulative strip (20), conductive sockets (21) in the strip (20), solder tabs (35) projecting from the sockets (21) and outwardly from a corresponding edge (29) of the strip (20), a bottom of the strip (20) serving as a first mounting surface for engagement against the circuit board (13), and the solder tabs (35) being adapted for being bent, first, in a direction toward the bottom of the strip, and then, to extend outwardly from the edge (29) at nearly the same level with the bottom, and the top (23) of the strip (20) serving as a second, alternative mounting surface for engagement with the circuit board (13).

18 Claims, 10 Drawing Sheets

FIG. 15
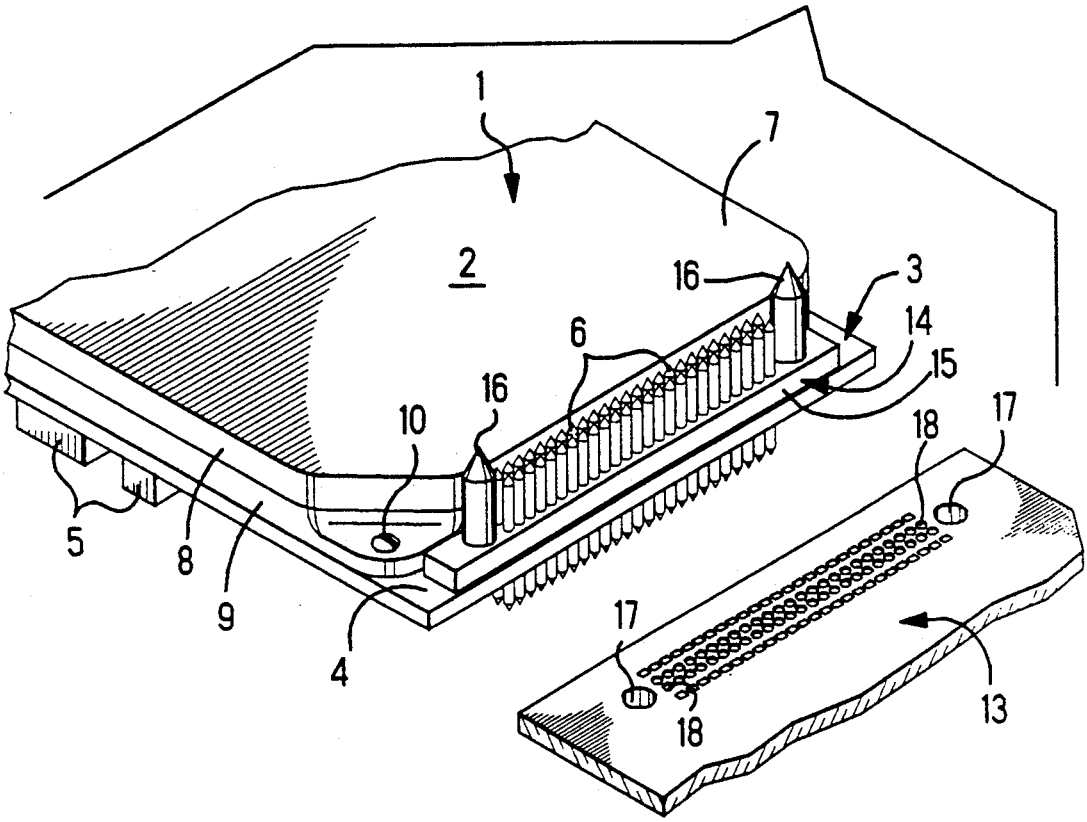
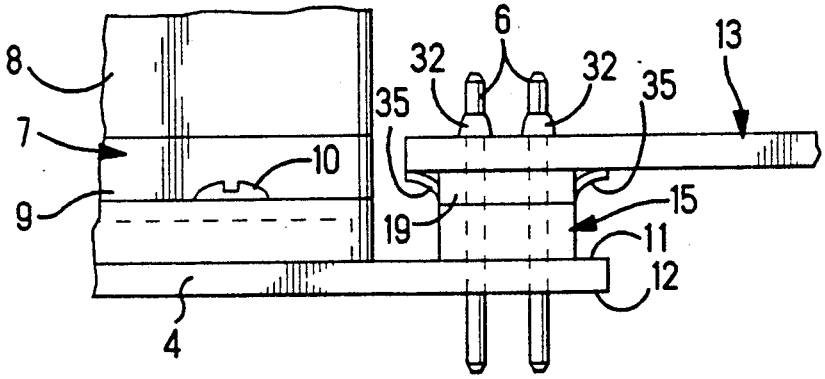
FIG. 16

RECEPTACLE HEADER OF LOW HEIGHT FOR CONNECTOR TO MULTIPLE PINS

This application is a continuation-in-part of application Ser. No. 07/787,842 filed Nov. 4, 1991, now abandoned.

FIELD OF THE INVENTION

The description of the invention relates to an electrical connector comprising, electrical receptacles in a header for connection to multiple conductive pins, and particularly, to an electrical connector in the form of a receptacle header of low height.

BACKGROUND OF THE INVENTION

U.S. Pat. No. 4,515,422 discloses an electrical device for connection to a circuit board, for example, a printed circuit board, PCB. Conductive pins project from the device and are received in conductive receptacles that are recessed in the circuit board. The receptacles engage surface conductors of the circuit board.

U.S. Pat. No. 3,487,350 discloses receptacles in a thin wafer of thermoplastic material, the receptacles being secured by solder to surface conductors of a circuit board.

SUMMARY OF THE INVENTION

The invention relates to an electrical connector comprising, electrical receptacles in an insulative header of low height, with solder tabs of the receptacles projecting from an edge of the header for alignment with, and connection to, surface conductors of a circuit board. Hereafter, the terms circuit board, printed circuit board and PCB, comprise terminology used interchangeably with one another.

According to the invention, an electrical connector comprises, an insulative strip having multiple passages, sockets in the passages, solder tabs projecting from the sockets and outwardly from a corresponding edge of the strip, pedestals of the strip supporting the solder tabs nearly at a level with a top of the strip, the top serving as a mounting surface for engagement against the circuit board.

Further according to the invention, the solder tabs are adapted for being bent, first, in a direction toward a bottom of the strip, and then, to extend outwardly from the edge of the strip at nearly the same level with the bottom when the solder tabs and the bottom are facing toward the circuit board, and the bottom serves as a second, alternative mounting surface for engagement with the circuit board.

The invention will now be described by way of example with reference to the accompanying drawings, in which;

FIG. 15 is a view similar to FIG. 12, with a pin header on the same side of the drive PCB as the head disk assembly;

FIG. 16 is a view similar to FIG. 14, with the pin header of FIG. 15 and the receptacle header of FIG. 1;

Figure 12:
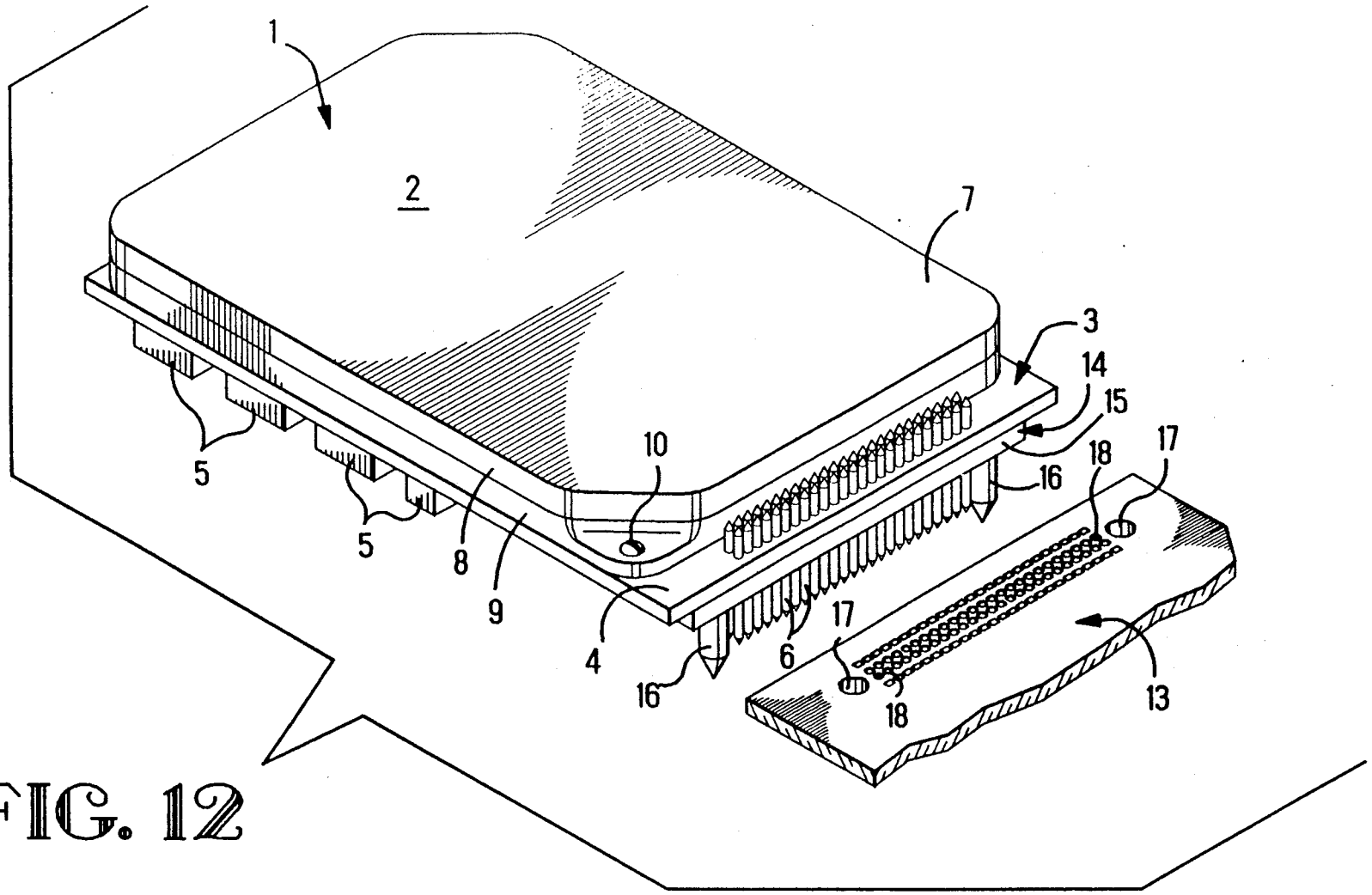
FIG. 12 is a fragmentary perspective view of a head disk assembly, a drive PCB, a pin header and a host PCB.
Figure 13:
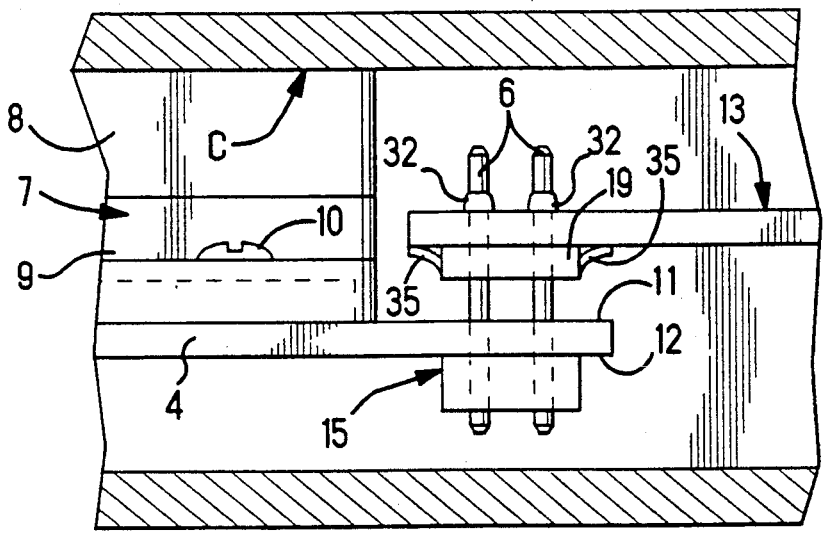
FIG. 13 is a fragmentary elevation view in section of a computer with the head disk assembly of FIG. 12, together with the drive PCB, the host PCB and a receptacle header of FIG. 1.

With reference first to FIG. 12, a disk drive 1 for being contained in a computer C, FIG. 13, is comprised of a head disk assembly, HDA, 2 and a drive PCB, printed circuit board 3. Electro-mechanical elements, not shown, of the disk drive 1 are confined to the head disk assembly, HDA, 2. The drive PCB, 3 comprises a circuit board 4 and integrated circuit devices 5 mounted on the circuit board 4 that control the operations of the electro-mechanical elements of the HDA, 2.

The HDA, 2 has an exterior height on the order of 6.4 mm. The drive PCB 3, including the integrated circuit devices 5, have a combined height of 2.5 to 2.8 mm. The height of the HDA 2 and the height of the drive PCB 3, when overlapped, one over the other, are together confined within 10 mm. overall height. A space between the overlapped HDA 2 and the drive PCB, 3 is about 0.8 mm.

The HDA, 2 and the drive PCB, 3 are connected by conductive pins 6 that extend from the HDA, 2, along two rows of pins 6, for connection to the drive PCB, 3. The pins 6 extend through the thickness of the drive PCB, 3 and project no more than 1.32 mm. beyond the thickness of the drive PCB, 3, a dimension less than the 1.7 mm height of the integrated circuit components 5 of the drive PCB, 3.

The head disk assembly, HDA, 2 comprises, a metal case 7 having a box 8 and a lid 9 secured by fasteners, one fastener shown at 10, to one surface 11 of the circuit board 4, on which the integrated circuit devices 5 are mounted on another surface 12 of the circuit board 4. The integrated circuit devices 5 are interconnected by electrical circuit paths, not shown, that extend over and along interior planar surfaces of the circuit board 4. The circuit paths of the circuit board 4 are required to be connected electrically to a host circuit board 13, the host PCB. Along an edge of the circuit board 4 that projects outwardly from the head disk assembly 2, is a pin header 14.

Figure 1:
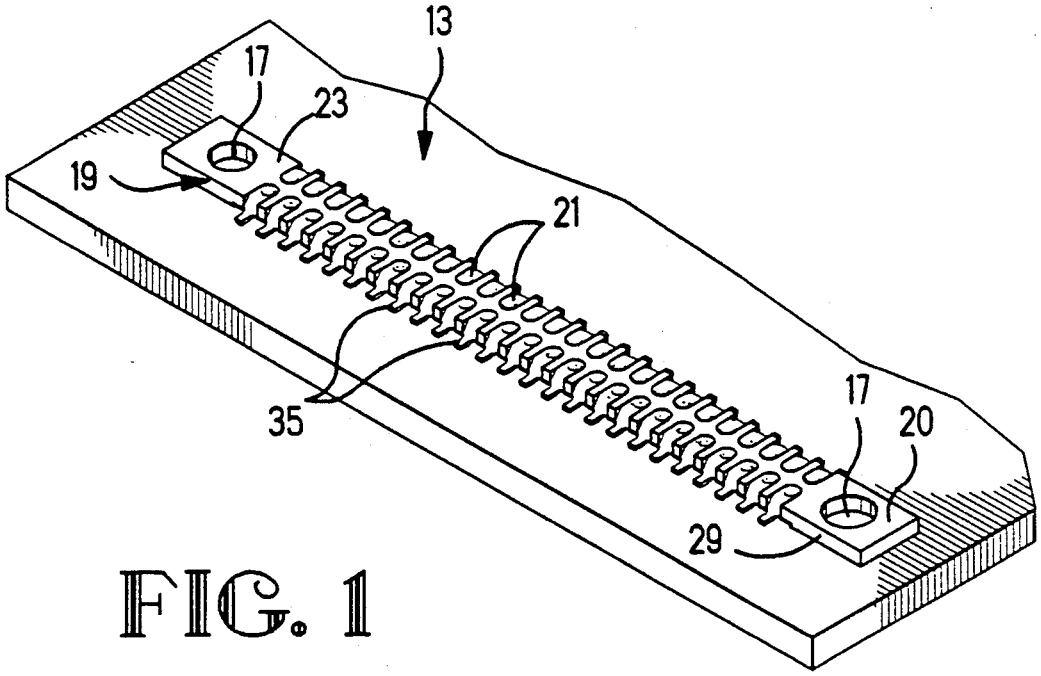
FIG. 1 is a fragmentary perspective view of an electrical connector comprising a receptacle header with a bottom mounted to a circuit board.
Figure 18:
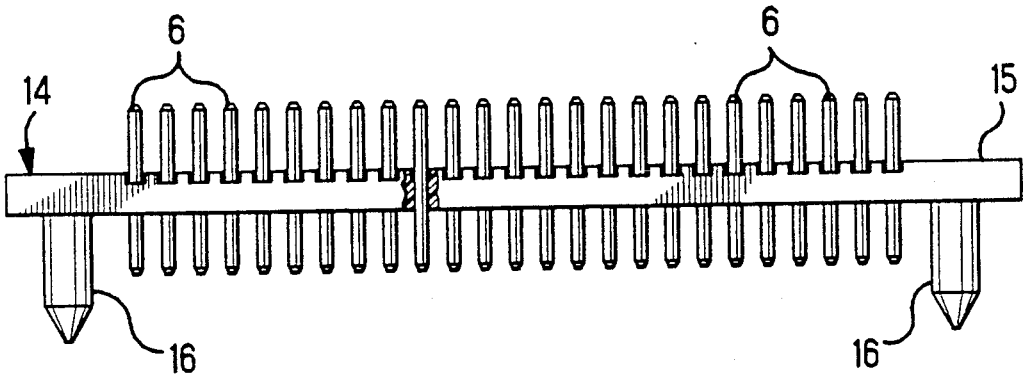

With reference to FIGS. 1 and 18, the pin header 14 is a type of electrical connector having an insulative strip 15 holding the conductive pins 6. The pins 6 pass through the strip 15 and provide electrical terminals that are connected to the circuit paths of the circuit board 4. The pins 6 project through the circuit board 4 to connect with the circuit paths. The pins 6 are not intended for removal from the circuit board 4, and thereby, provide permanent electrical connections for the circuit board 4. The pins 6 can extend from opposite sides of the pin header 14. The lengths of the pins 6 determines how many items can be stacked along the pins 6 in a skewer like manner. The header 14 can be provided with alignment posts 16 with pointed ends that extend slightly farther than the pins 6 from the strip 15. The posts 16 are relatively larger in diameter than the pins 6, and are used in the following manner.

Figure 14:
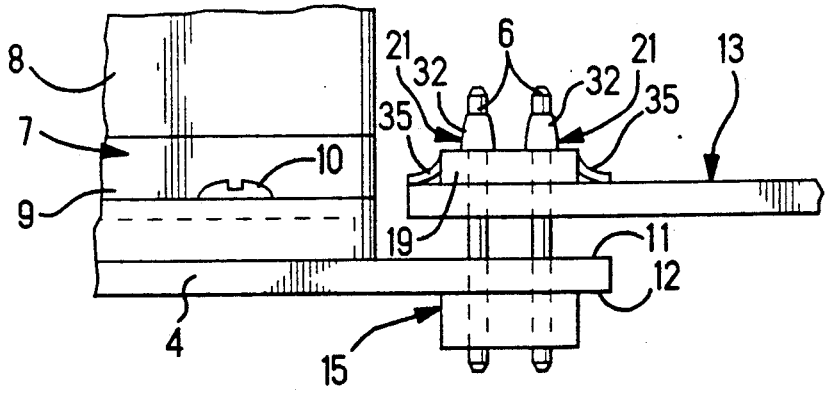
FIG. 14 is a fragmentary elevation view in section of the head disk assembly of FIG. 13, together with the drive PCB, the host PCB and a receptacle header of FIG. 2.

The pin header 14 is mounted near the edge of the circuit board 4 against the surface 12, in each of FIGS. 12, 13 and 14, with the alignment posts 16 projecting for registration in corresponding alignment holes 17, FIG. 12, of the host circuit board 13. Once the alignment posts 16 are in registration with the alignment holes 17, the pins 6 will then be aligned with corresponding, pin receiving holes 18 of the host circuit board 13, arranged in two rows. Damage to the pins 6 by trying to insert them into the holes 18 is averted, by first registering the alignment posts 16 with the alignment holes 17. Once the pins 16 are in the holes 17, the two circuit boards 4 and 13 can be moved toward each other. The pin header 14 can be mounted against the surface 11 of the circuit board 4, as in FIGS. 15, 16 and 17.

There is a requirement for a connection of the pins 6 to the host circuit board 13 that is capable of being disconnected, for example, to remove the HDA, 2 for repair or replacement. In addition, the HDA, 2 and host circuit board 13 are separate articles of manufacture, which creates a need for a quick assembly technique to interconnect the pins 6 of the HDA, 2 to the host circuit board 13.

Such a technique resides in the application of an electrical receptacle header 19, as disclosed hereinafter. Unlike the permanent electrical connections of the pins 6 to the circuit board 4, the pins 6 are required to be removed from the host circuit board 13, for example, to remove the head disk assembly 2 from the host circuit board 13 for repair or replacement. Accordingly, electrical connections of the pins 6 to the host circuit board 13 must be capable of being disconnected. This is accomplished by the electrical connector 19 in the form of a receptacle header, as disclosed with reference to FIGS. 1 through 11.

The electrical connector 19, in the form of a receptacle header, comprises, an insulative strip 20 and metal sockets 21. The strip 20 is of unitary construction adapted for fabrication by molding an industrial plastic material. A mounting surface 22 for mounting the connector 19 to the host circuit board 13 is provided by a top 23 of the strip 20. A bottom 24 of the strip 20 is defined on the bottoms of projecting mounting feet 25 that elevate the strip 20. An alternative mounting surface 22 for mounting the connector 19 to the host circuit board 13 is provided by the bottom 24 of the strip 20 distributed among the bottoms of the feet 25. Alignment openings 26 extend through the strip 20 from the top 23 to the bottom 24, and extending through the feet 25. The openings 26 align with the alignment holes 17 of the host circuit board 13, to receive the alignment posts 16 of the pin header 14. Multiple passages 27 extend through the top 23 of the strip 20 in a direction from the top 23 to the bottom 24. Channels 28, FIGS. 4 and 6, recessed in the top 23 of the strip 20 intersect corresponding passages 27, and extend from the passages 27 to a corresponding edge 29 of the strip 20. Knob like pedestals 30 project into the channels 28 and extend toward the top 23. The pedestals 30 extend in a direction away from the bottom 24 of the strip 20.

The metal sockets 21 are of unitary construction, with open, cylindrical tops 31, and depending receptacle portions 32. Each of the receptacle portions 32 comprises four elongated fingers 33 separated by longitudinal slits 34. The fingers 33 are resiliently deflected upon receipt of the pins 6 into the receptacles 32. Elongated solder tabs 35 intersect the open ends 31 of the sockets 21. The sockets 21 are assembled in the passages 27. The open ends 31 of the sockets 21 extend at a level no higher than the level of the top 23 of the strip 20. The solder tabs 35 are supported against tops of the pedestals 30, FIGS. 7 and 10, to hold the sockets 21 from movement further along the passages 27. Each of the passages 27 has a flat side 36 to compress against the corresponding cylindrical socket 21 to hold the socket 21 in place. The pedestals 30 are recessed from the top 23 to support the solder tabs 35 at a level, FIGS. 7 and 10, no higher than the level of the top 23, especially since the top 23 comprises one of the mounting surfaces 22 of the strip 20.

Figure 2:
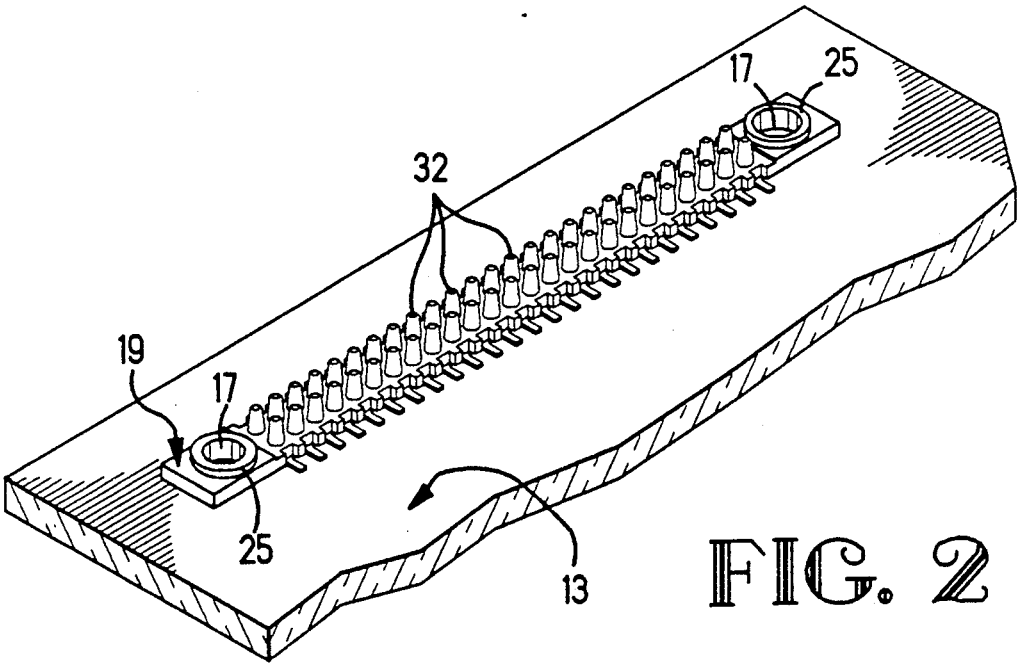
FIG. 2 is a fragmentary perspective view of the electrical connector of FIG. 1 with a top mounted to a circuit board.
Figure 3:
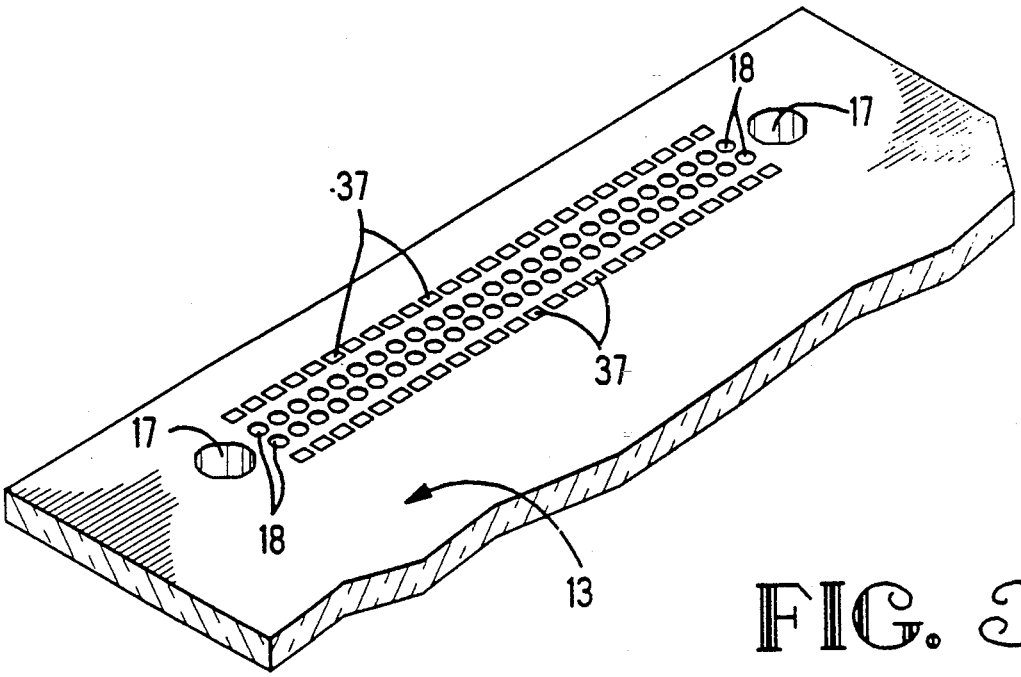
FIG. 3 is a fragmentary perspective view of a circuit board having two alignment openings and two rows of socket receiving openings adjacent to circuit pads.
Figure 4:
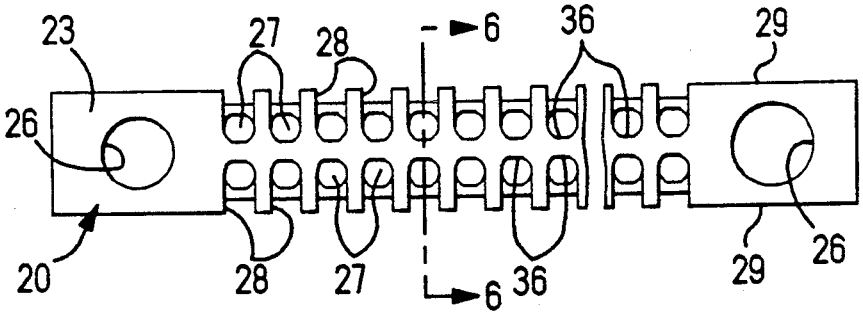
FIG. 4 is a fragmentary top plan view of a strip of the electrical connector of FIG. 1.
Figure 5:
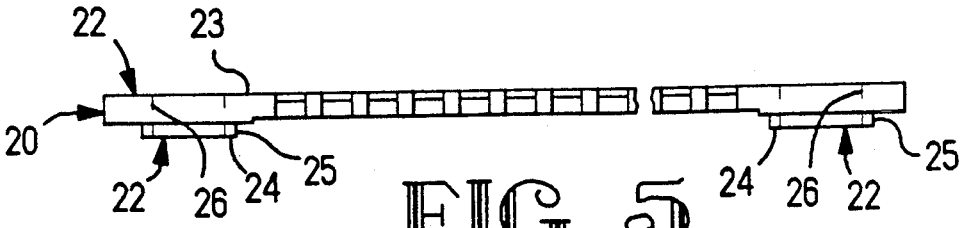
FIG. 5 is a fragmentary side elevation view of the strip of FIG. 4.
Figure 6:
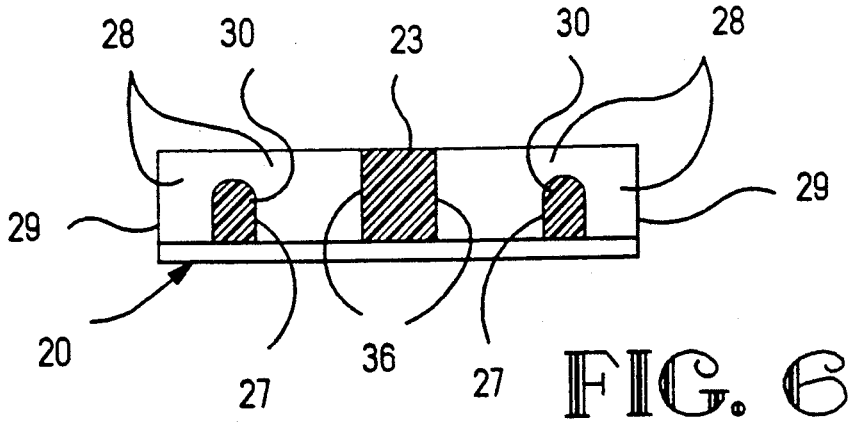
FIG. 6 is a section view taken along line 6—6 of FIG. 4.
Figure 10:
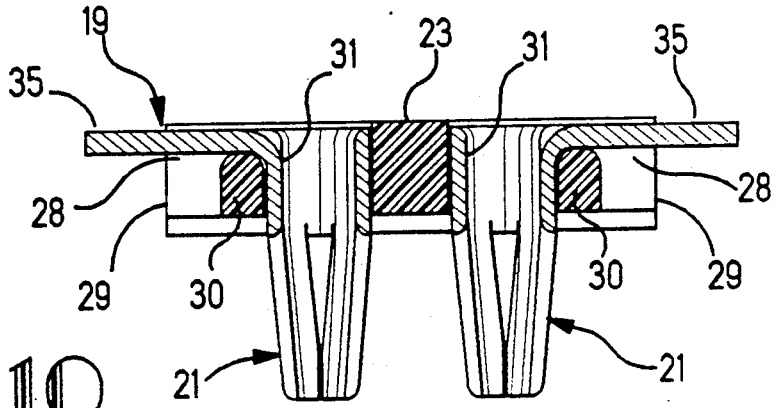
FIG. 10 is a view similar to FIG. 7, illustrating the socket of FIG. 7 adapted for mounting to a circuit board as shown in FIG. 2.
Figure 11:
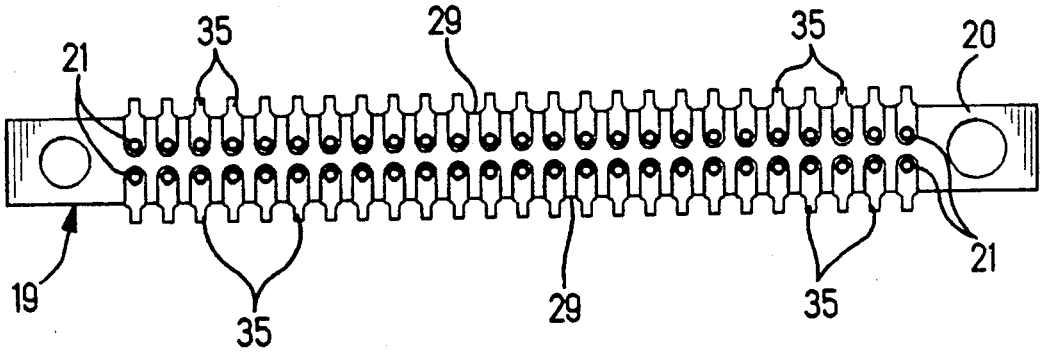
FIG. 11 is a view similar to FIG. 4, together with sockets adapted as shown in FIG. 7.
Figure 17:
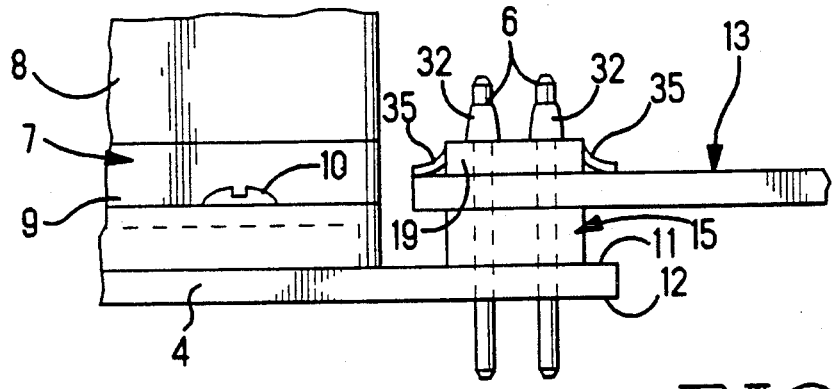
FIG. 17 is a view similar to FIG. 16, with a receptacle header of FIG. 2.

The solder tabs 35 extend outwardly from the pedestals 30 and are at nearly the same level as the top 23 when the top 23 serves as the mounting surface 22. The connector 19 of FIG. 10 is adapted for mounting to the circuit board 13, as shown in FIGS. 2, 14 and 17, with the top 23 serving as the mounting surface 22 engaging the circuit board 13, and with the receptacle portions 32 extending from the strip 20 and away from the circuit board 13. The solder tabs 35, FIG. 10, extend straight outwardly from the pedestals 30, FIGS. 2 and 10, and extend outwardly of a corresponding edge 29 of the strip 20 to overlie corresponding conductive pads 37, FIG. 3. The conductive pads 37 are shown rectangular in shape, and are adjacent corresponding holes 18 of the host circuit board 13. The solder tabs 35, FIGS. 2 and 10, of the sockets 21 extend along the channels 28 of the strip 20. Widths of the solder tabs 35 bridge the widths of the channels 28, and are constrained by the channels 28 to project straight outward from a corresponding side edge 29 of the strip 20. The channels 28 align the solder tabs 35 with the circuit pads 37 of the host circuit board 13.

Figure 7:
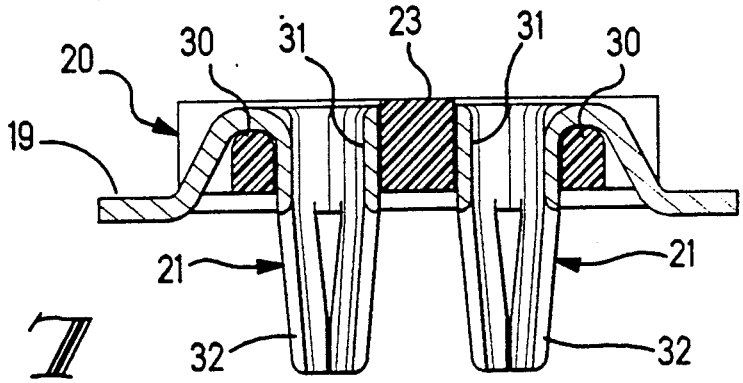
FIG. 7 is a view similar to FIG. 6 with sockets assembled to the strip, and adapted for mounting to a circuit board as shown in FIG. 1.

The electrical connector of FIGS. 7 and 10 is adapted for mounting to the circuit board 13, as shown in FIGS. 1, 13 and 16, using the bottom 24 of the strip 20 to serve as a second, alternative mounting surface 22. The solder tabs 35, prior to being supported on the pedestals 30, are bent, FIGS. 7 and 8, to extend first, in a direction toward the bottom 24, and along the channels 22 that are recessed from the corresponding edge 29 of the strip 20. Then the solder tabs 35 are reversely bent to extend outwardly from the edge 29 of the strip 20 at nearly the same level with the bottom 24, when the solder tabs 35 and the bottom 24 face the circuit board 13 to engage against the circuit board 13.

The receptacle portions 32 of the sockets 21 project beyond the bottom 24 of the strip 20. When the bottom 24 becomes the mounting surface 22, the receptacle portions 32 of the sockets 21 are adapted for recessed receipt in the holes 18 of the circuit board 13. The mounting surface 22 is at a level corresponding to the bottom 24 of the strip, when the bottom 24 faces the circuit board 13, FIG. 1. The receptacle portions 32 of the sockets 21 project beyond the bottom 24 of the strip 20 for recessed receipt in the holes 18 of the circuit board 13.

Figure 8:
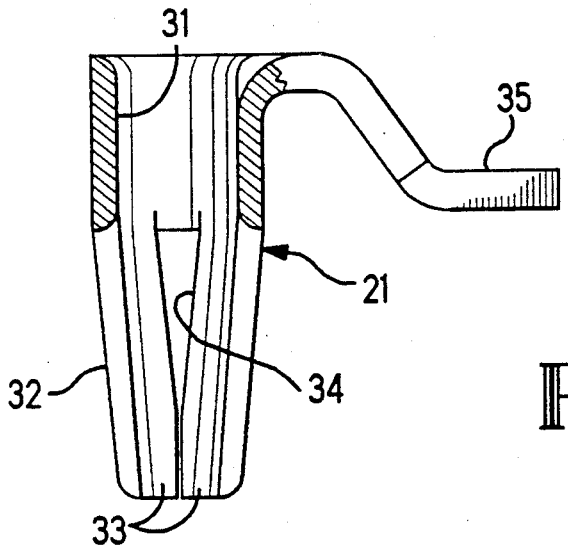
FIG. 8 is an enlarged side elevation view of a socket shown in FIG. 4, with parts broken away to illustrate details thereof.
Figure 9:
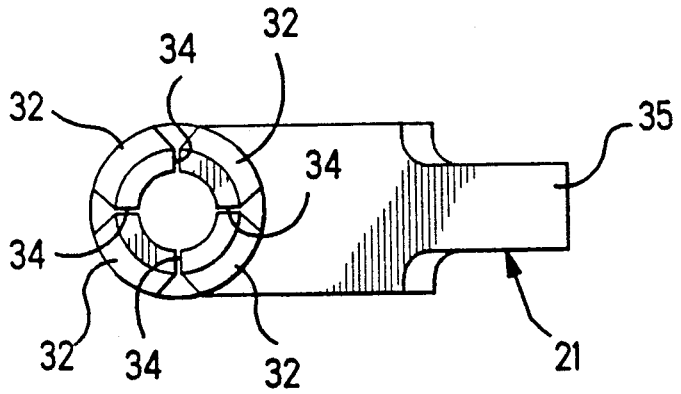
FIG. 9 is a top plan view of the socket of FIGS. 7 and 8.

In either FIG. 7 or FIG. 8, the solder tabs 35 project out of the corresponding edge 29 of the strip 20, and are substantially at the same level with one another, and are nearly at the level of the mounting surface 23, when the solder tabs 35 overlie the conductive pads 37 of the circuit board 13, and when the mounting surface 22 engages against the circuit board 13. The solder tabs 35 are coated with solidified solder. The solder can be heated to a fluent state to provide conductive solder joints, joining the solder tabs 35 securely to the circuit pads 37.

Figure 19:
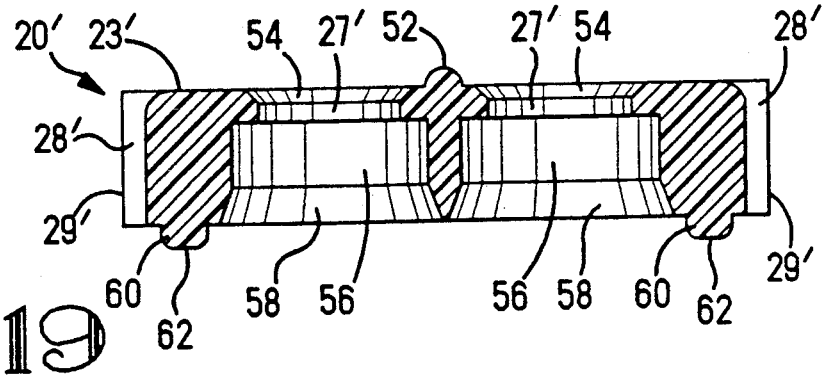
FIG. 19 is a view similar to FIG. 6 of an alternative embodiment.
Figure 20:
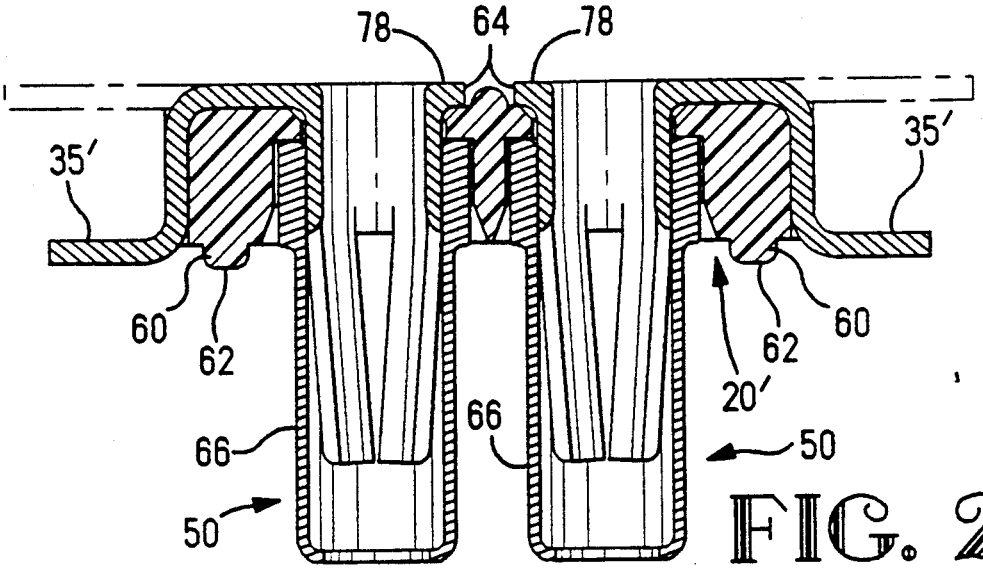
FIG. 20 is a view similar to FIG. 7 of the embodiment shown in FIG. 19, together with sockets.
Figure 21:
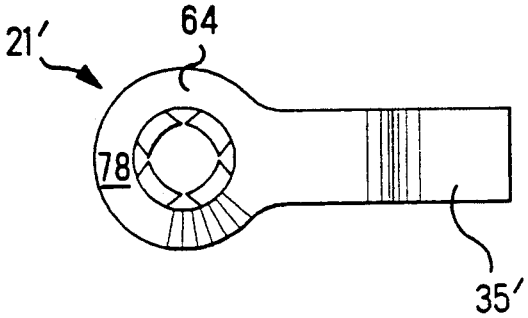
FIG. 21 is a top plan view of a socket as shown in FIG. 20.
Figure 22:
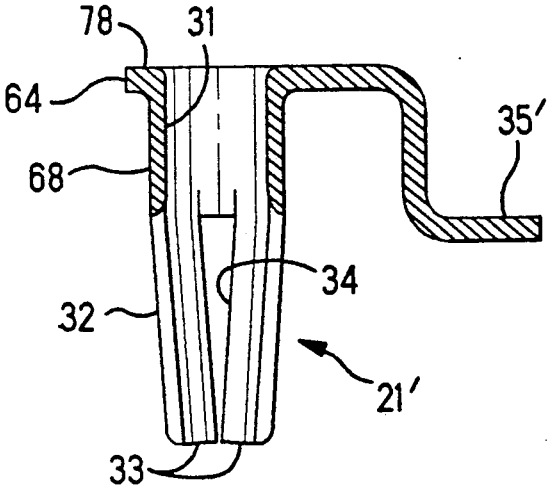
FIGS. 22 and 23 are elevation view in section of parts of the socket shown in FIG. 20.
Figure 23:
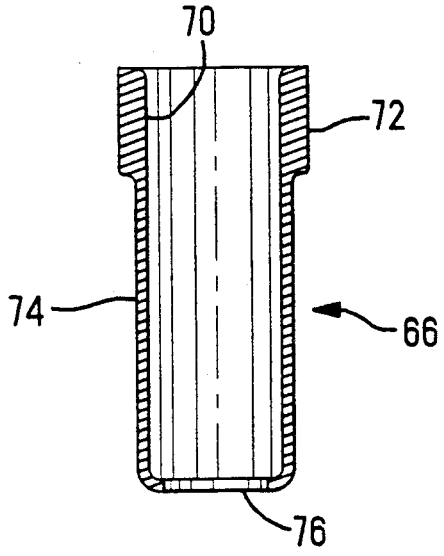

An alternative embodiment of the present invention is shown in FIGS. 19 through 23 wherein a two part socket 50 is utilized in place of the one part socket 21. Features shown in FIGS. 19 through 23 corresponding to similar features of the strip 20 and socket 21 are identified with similar numerals followed by a prime sign (′). Identical features carry the identical numerals without the prime sign. There is shown in FIG. 19 a cross-sectional view of a strip 20′ similar to the strip 20. A single stiffening rib 52 extends along the top surface 23′ of the strip 20′. There are multiple passages 27′ which extend through the top 23′ of the strip. Each passage 27′ includes a chamfer 54 in the top surface 23′ and a counterbore 56 with a lead-in chamfer 58 extending from the bottom. A plurality of bosses 60 are disposed along the lower surface of the strip 20′, as viewed in FIG. 19, one such boss being adjacent each passage 27′. The lower surface 62 of the bosses are flush with the bottoms 24. A plurality of channels 28′ are formed in the edges 29′ of the strip 20′, one such channel being opposite each passage 27′. The two part socket 50 of the embodiment, shown in FIGS. 21, 22 and 23, includes a metal socket 21′ of unitary construction which is similar to the socket 21 except that an annular flange 64 is formed at the cylindrical top 31 and solder tabs 25′, similar to the solder tabs 35, project outwardly from the flange 64. The two part socket 50 further includes a metal tubular shaped outer casing 66, as best seen in FIG. 23, which slides over the fingers 33 of the socket 21′ and tightly engages a diameter 68 of the socket just under the flange 64, as best seen in FIG. 20. The inner diameter 70 of the casing 66 is an interference fit with the diameter 68 of the socket 21′, while the outer diameter 72 of the casing loosely enters the counterbore 56 of the strip 20′. This permits assembly of the two part socket 50 to the strip 20′, as shown in FIG. 20, wherein the sockets 21′ are first inserted into the passages 27′ and then the casings 66 pressed into place. Note that the casings 66 may or may not bottom in the counterbores 56. If they do not bottom, then the two part sockets 50 may have some slight side play that would be beneficial when inserting into the holes 18 of the printed circuit board 13. The casing 66 includes a shroud 74 which serves to protect the delicate fingers 33 of the socket 21′. An opening 76 is formed in the end of the casing for clearance for mating male pins such as the pins 6 of the disc drive unit 1. When the two part socket 50 is assembled to the strip 20′, as shown in FIG. 20, the tabs 35′ are positioned substantially flush with the surfaces 62 of the bosses 60 so that when the assembly is mounted to a printed circuit board, the tabs 35′ will contact metalization on the board and may be soldered thereto, similar to that shown in FIG. 1. Alternatively, the strip 20′ may be mounted to the circuit board from the opposite side so that the casings 66 are directed away from the board similar to that shown in FIG. 2. In this case, the tops 78 of the flanges will contact the surface of the printed circuit board and the tabs 35′ will extend straight out from their respective flanges 64 as shown in phantom lines in FIG. 20. It will be understood by those skilled in the art that the shroud 74 may be omitted from the casing 66 while advantageously practicing the teachings of the present invention.

Figure 24:
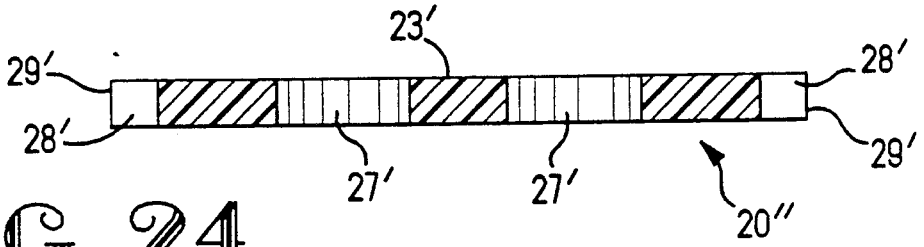
FIG. 24 is a view similar to FIG. 7 of an alternative embodiment.
Figure 25:
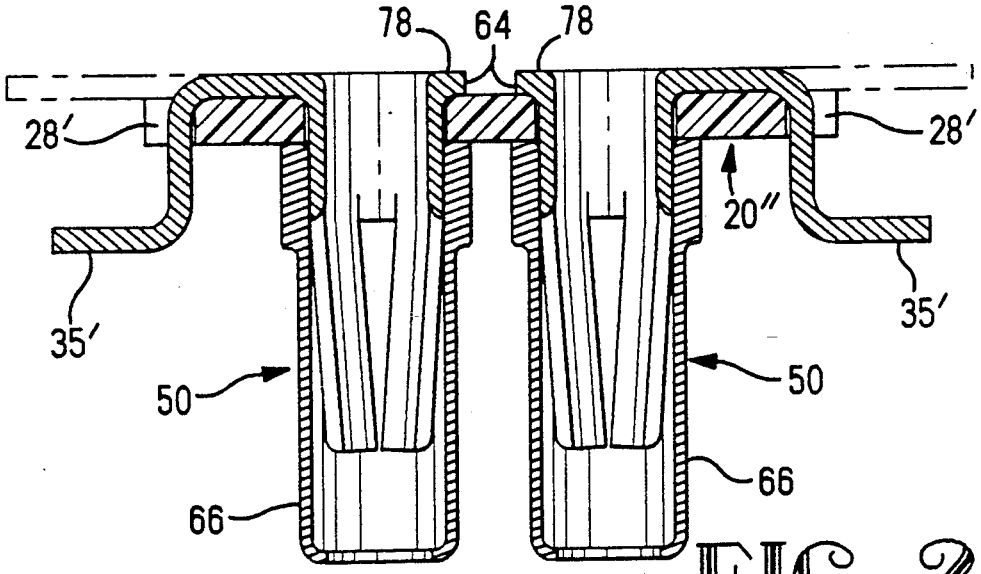
FIG. 25 is a view similar to FIG. 21 of the embodiment shown in FIG. 24, together with sockets.

Another embodiment of the present invention is shown in FIGS. 24 and 25. In this embodiment the strip 20′ is replaced by a substantially flat strip 20″ having a plurality of passages 27′ and a corresponding number of channels 28′ formed in the edges 29′, one such channel being opposite each passage 27′. As is shown in FIG. 25, the two part socket 50 is assembled to the strip 20″ in a manner similar to that of the strip 20′ so that the assembly can be mounted to the printed circuit board in either of the two ways shown in FIGS. 1 and 2. The primary difference being that the strip 20″ will be spaced from the printed circuit board.

Although preferred embodiments of the invention are disclosed, other embodiments and modifications are intended to be covered by the spirit and scope of the claims.

We claim:

1. An electrical connector for mounting against a circuit board having multiple holes, comprising: an insulative strip having multiple passages aligned with the holes, conductive sockets in the passages, solder tabs projecting from the sockets and outwardly from a corresponding edge of the strip, pedestals of the strip supporting the solder tabs nearly at a level with a top of the strip, the top serving as a first mounting surface for engagement against the circuit board, and the solder tabs being adapted for being bent, first, in a direction toward a bottom of the strip, and then, to extend outwardly from the edge of the strip at nearly the same level with the bottom when the solder tabs and the bottom are facing toward the circuit board, and the bottom serving as a second, alternative mounting surface for engagement with the circuit board.

2. An electrical connector as recited in claim 1, wherein, the sockets project outwardly from the bottom of the strip and are adapted for receipt in the holes when the solder tabs and the bottom are facing toward the circuit board.

3. An electrical connector as recited in claim 1, and further comprising: channels recessed in the top of the strip and intersecting the openings, and the solder tabs being aligned by the channels to project outwardly from a corresponding edge of the strip and over surface conductors of the circuit board.

4. An electrical connector as recited in claim 1, wherein, the channels are recessed in the corresponding edge of the strip, and being adapted to receive the tabs when the solder tabs have been bent in said direction toward the bottom of the strip.

5. An electrical connector as recited in claim 1, wherein, the solder tabs intersect open ends of the sockets, the open ends of the sockets extend at a level no higher than the level of a top of the strip, and the pedestals are recessed from the top to support the solder tabs at a level no higher than the level of the top.

6. An electrical connector, comprising: an insulative strip having multiple passages, sockets in the passages, solder tabs projecting from the sockets and outwardly from a corresponding edge of the strip, pedestals of the strip supporting the solder tabs nearly at a level with a top of the strip, the top serving as a first mounting surface for engagement against a circuit board, and the solder tabs being adapted for being bent, first, in a direction toward a bottom of the strip, and then, to extend outwardly from the edge of the strip at nearly the same level with the bottom when the solder tabs and the bottom are facing toward the circuit board, and the bottom serving as a second, alternative mounting surface for engagement with the circuit board.

7. An electrical connector as recited in claim 6, wherein, the sockets project outwardly from the bottom of the strip and are adapted for receipt in circuit board holes when the solder tabs and the bottom are facing toward the circuit board.

8. An electrical connector as recited in claim 6, and further comprising: channels recessed in the top of the strip and intersecting the passages, and the solder tabs being aligned by the channels to project outwardly from a corresponding edge of the strip and over surface conductors of the circuit board.

9. An electrical connector as recited in claim 6, wherein, the channels are recessed in the corresponding edge of the strip, and being adapted to receive the tabs when the solder tabs have been bent in said direction toward the bottom of the strip.

10. An electrical connector as recited in claim 6, wherein, the solder tabs intersect open ends of the sockets, the open ends of the sockets extend at a level no higher than the level of a top of the strip, and the pedestals are recessed from the top to support the solder tabs at a level no higher than the level of the top.

11. An electrical connector of low height, comprising: metal sockets having unitary solder tabs projecting from pin receiving, open top portions of the sockets; receptacle portions of the sockets depending from the open top portions; an insulative strip; multiple passages through the strip from a top of the strip to a bottom of the strip; and the sockets being received in the passages with the solder tabs of the sockets extending in recessed positions along the top of the strip and extending beyond corresponding edges of the strip for connection to circuit pads of a circuit board with the top of the strip facing the circuit board; and pedestals of the strip recessed in the top of the strip; said pedestals supporting the solder tabs in said recessed positions.

12. An electrical connector of low height as recited in claim 11, and further comprising: flanges on the top portions of the sockets, and casings in the passages encircling the top portions with interference fits, portions of the strip being sandwiched between the flanges and the casings.

13. An electrical connector of low height as recited in claim 11, and further comprising: shrouds on the casings encircling the receptacle portions of the sockets.

14. An electrical connector of low height as recited in claim 11, wherein, the solder tabs extending beyond the corresponding edges of the strip are adapted for being bent, first, in a direction toward the bottom of the strip, and then, in another direction for extending outwardly from the corresponding edges of the strip such that the solder tabs are adapted for connection to the pads of the circuit board with the bottom facing toward the circuit board instead of the top facing the circuit board.

15. An electrical connector of low height, comprising: metal sockets having unitary solder tabs projecting from pin receiving, open top portions of the sockets with flanges on the top portions; receptacle portions of the sockets depending from the open top portions; an insulative strip; multiple passages through the strip from a top of the strip to a bottom of the strip; and the sockets being received in the passages with the solder tabs of the sockets extending along the top of the strip and extending beyond corresponding edges of the strip for connection to circuit pads of a circuit board with the top of the strip facing the circuit board; and casings in the passages encircling the top portions with interference fits; and portions of the strip being sandwiched between the flanges and the casings.

16. An electrical connector of low height as recited in claim 15, and further comprising: shrouds on the casings encircling the receptacle portions of the sockets.

17. An electrical connector of low height as recited in claim 15, wherein, the solder tabs extending beyond the corresponding edges of the strip are adapted for being bent, first, in a direction toward the bottom of the strip, and then, in another direction for extending outwardly from the corresponding edges of the strip such that the solder tabs are adapted for connection to the circuit board with the bottom facing toward the circuit board instead of the top facing the circuit board.

18. An electrical connector as recited in claim 15, wherein, channels are in the top of the strip and extend from the passages to the edges, pedestals project into the channels, and the solder tabs are supported against the pedestals to hold the sockets from movement along the passages.

* * * * *